US009428957B2

(12) United States Patent
Swafford

(10) Patent No.: US 9,428,957 B2
(45) Date of Patent: Aug. 30, 2016

(54) CLASSIC STEP STORE GATE

(71) Applicant: Robert Lee Swafford, West Frankfort, IL (US)

(72) Inventor: Robert Lee Swafford, West Frankfort, IL (US)

( * ) Notice: Subject to any disclaimer, the term of this patent is extended or adjusted under 35 U.S.C. 154(b) by 0 days.

(21) Appl. No.: 13/915,536

(22) Filed: Jun. 11, 2013

(65) Prior Publication Data

US 2014/0173987 A1 Jun. 26, 2014

Related U.S. Application Data

(60) Provisional application No. 61/689,658, filed on Jun. 11, 2012.

(51) Int. Cl.

| | |
|---|---|
| ***E06B 5/06*** | (2006.01) |
| ***E06B 11/02*** | (2006.01) |
| ***E06B 9/06*** | (2006.01) |
| ***E05D 5/06*** | (2006.01) |
| *E06B 9/00* | (2006.01) |
| *E06B 9/01* | (2006.01) |
| *E05D 3/02* | (2006.01) |

(52) U.S. Cl.

CPC ..... *E06B 11/022* (2013.01); *E05D 5/06* (2013.01); *E06B 9/0623* (2013.01); *E05D 3/02* (2013.01); *E05Y 2900/40* (2013.01); *E06B 11/023* (2013.01); *E06B 2009/002* (2013.01); *E06B 2009/015* (2013.01); *Y10T 16/554* (2015.01)

(58) Field of Classification Search

CPC .... E06B 11/02; E06B 11/022; E06B 11/023; E06B 9/0623; E05D 5/06

USPC ..... 49/226, 232–234; 52/184, 174; 160/210, 215, 212

See application file for complete search history.

(56) References Cited

U.S. PATENT DOCUMENTS

| | | | | |
|---|---|---|---|---|
| 5,022,197 | A * | 6/1991 | Aragona | 52/29 |
| 5,056,283 | A * | 10/1991 | Sapinski | 52/184 |
| 5,134,806 | A * | 8/1992 | Burkart, Jr. | 49/463 |
| 5,735,100 | A * | 4/1998 | Campbell | 52/645 |
| 6,112,460 | A * | 9/2000 | Wagnitz | 49/55 |
| 6,932,141 | B2 * | 8/2005 | Cook | 160/210 |
| 6,935,000 | B1 * | 8/2005 | Arnaud | 16/239 |
| 7,000,673 | B2 * | 2/2006 | Cook | 160/210 |
| 7,318,298 | B2 * | 1/2008 | Marsden et al. | 49/57 |
| 7,739,834 | B2 * | 6/2010 | Stoffels et al. | 49/49 |
| 8,615,928 | B2 * | 12/2013 | Wang | 49/226 |
| 2003/0009945 | A1 * | 1/2003 | Cheng | 49/57 |
| 2006/0042163 | A1 * | 3/2006 | Nitz et al. | 49/55 |
| 2008/0277550 | A1 * | 11/2008 | Rowley | 248/231.21 |
| 2009/0044450 | A1 * | 2/2009 | Hallman | 49/50 |
| 2009/0158666 | A1 * | 6/2009 | Atkinson et al. | 49/55 |

* cited by examiner

*Primary Examiner* — Katherine Mitchell
*Assistant Examiner* — Scott Denion
(74) *Attorney, Agent, or Firm* — MU Patents; Garrett James O'Sullivan; Timothy Marc Shropshire

(57) ABSTRACT

The gate may be fixed within a doorway or into walls above stairs. The gate is constructed of two horizontal beams pivotally connected by vertical beams, joined by pivot pins. At one end, the horizontal beams are pivotally connected to a hinge so that they may pivot vertically relative to the hinge, which is connected to one side of a door frame and permits the gate to swing open and closed. When closed, the gate latches into saddles on the opposite side of the door frame. When open, the entire gate pivots vertically to incline in a direction of the stairs. When pivoting vertically, the vertical beams remain vertical and the horizontal beams incline.

8 Claims, 7 Drawing Sheets

CLASSIC STEP STORE GATE

CROSS-REFERENCE TO RELATED APPLICATION

This application claims the benefit of U.S. Provisional Application No. 61/689,658 filed on Jun. 11, 2012 by Robert L Swafford entitled Classic Step Store Gate, which is incorporated herein by reference.

FIELD OF THE INVENTION

The invention relates to a gate for the top or bottom of stairs.

DETAILED DESCRIPTION

Figure 1B:
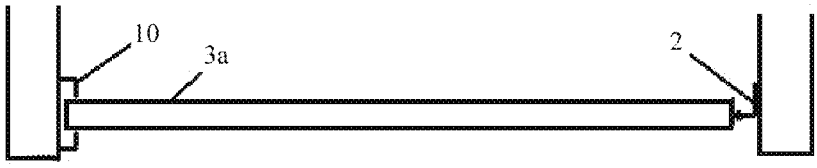
FIG. 1B is a top plan view of the gate, according to an embodiment of the present invention.
Figure 1A:
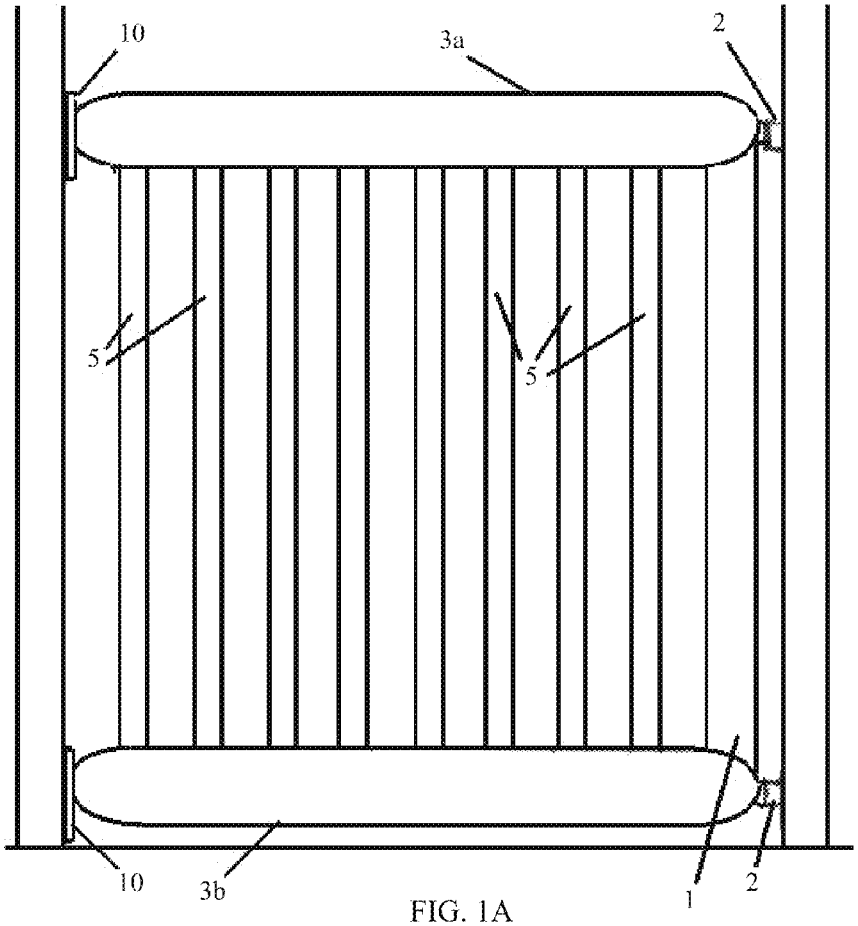
FIG. 1A is a front elevation view of the gate, according to an embodiment of the present invention.
Figure 1C:
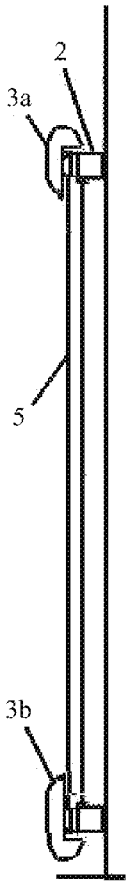
FIG. 1C is a side elevation view of the gate, according to an embodiment of the present invention.

With reference to FIGS. 1A to 1C, front Elevation view exhibits a clean structure, with no screws, nails or pivot pins visible. The top of the gate is a rounded handrail measuring, one and one half inches or more in thickness, extending across the opening and rounding at the ends. This gate is sturdy and attractive. The gate lifts or lowers to move up or down stairs or a slope to open or block a passageway. It was developed for safety, strength, usefulness, and is up to date with quality homes. This gate uses a modified bent strap hinge, combined with a pivot pin, to allow it to be lifted upward or downward.

The top beam 3*a* of Classic Step Store Gate is a strong rounded handrail for safety. The bottom beam 3*b* is equal to top beam inverted. The gate can be rotated 180 degrees and mount left or right hinge. The horizontal beams 3*a*, 3*b* are recessed to allow the vertical members 5 to mount flush with the top beam 3*a* and bottom beam 3*b*. Nothing projects above the top beam (a safety feature). All screws or pivot pins (not shown) are inserted from the back of the gate. The front is un-cluttered.

Figure 6:
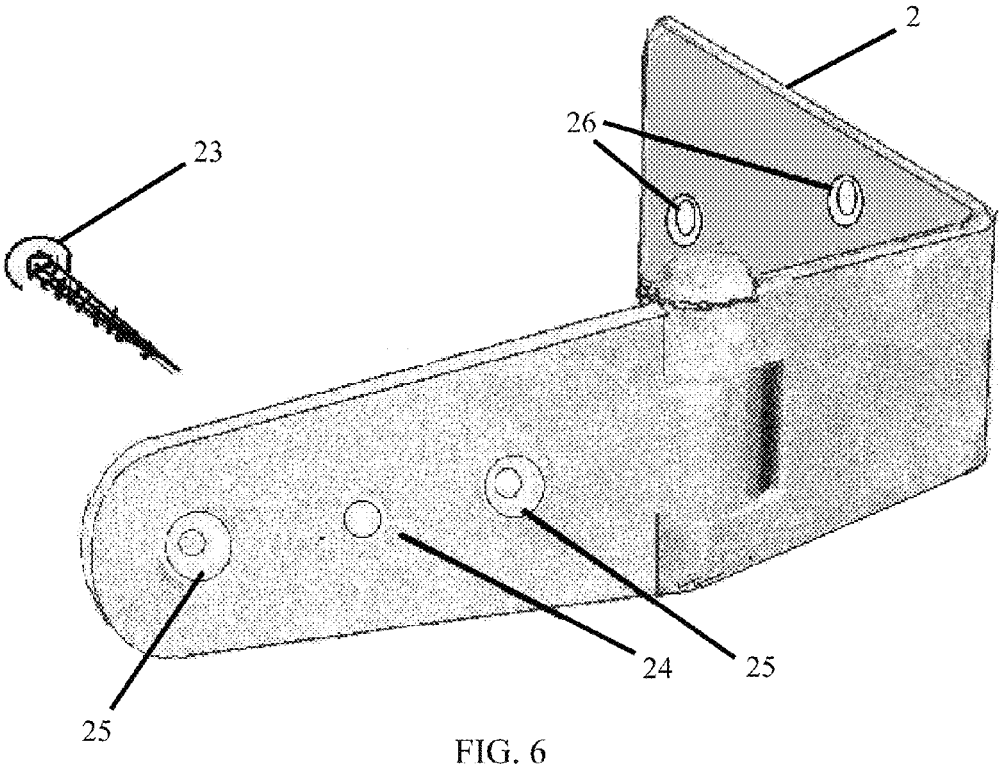
FIG. 6 is a detail view of the hinge, according to an embodiment of the present invention.
Figure 7A:
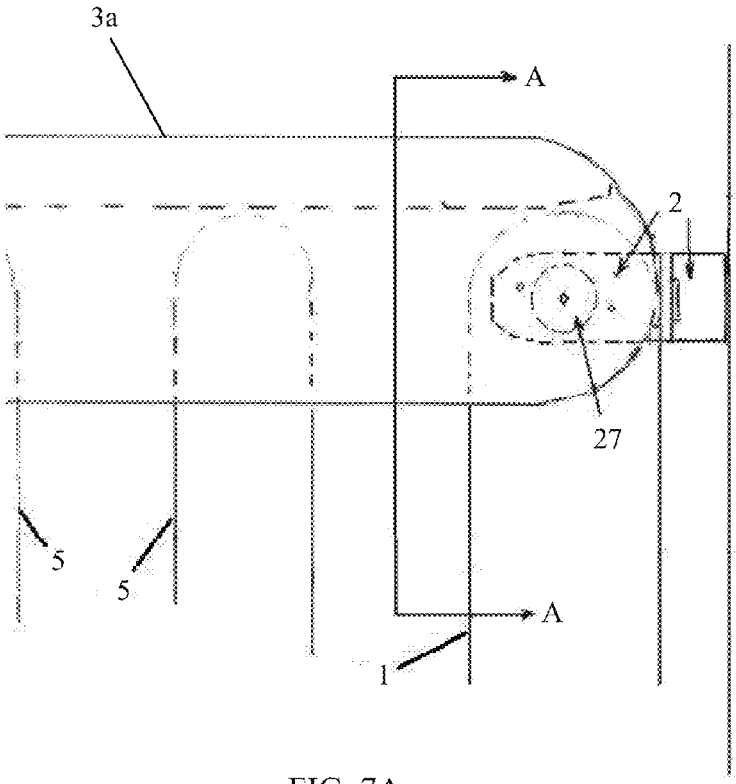
FIG. 7A is a front detail view of the installed hinge, according to an embodiment of the present invention.
Figure 7B:
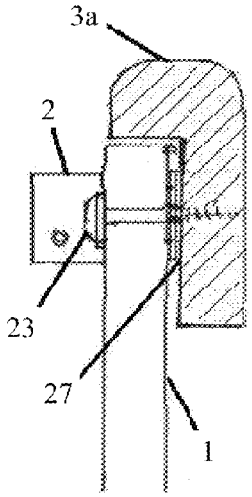
FIG. 7B is a side detail view across section A-A of the installed hinge, according to an embodiment of the present invention.
Figure 7C:
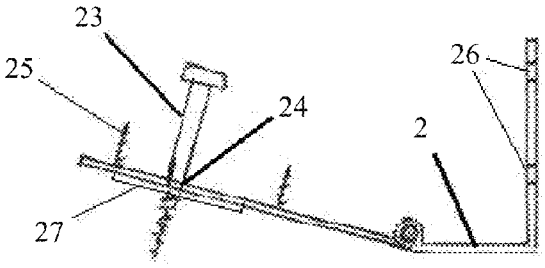
FIG. 7C is a detail top view of the hinge, according to an embodiment of the present invention.

With additional reference to FIGS. 6 and 7C, this gate is not built with a pivot post as my patent No. 61/687,908 is built. It does not use top and bottom brackets. The gate uses modified strap hinges 2. One hinge 2 is near the top, and one near the bottom. These two hinges 2 attach to the first vertical member 5 of the gate, with two screws 25 into the vertical beam. Two screws (not shown) attach the opposite end of the hinge to the wall or door jamb through holes 26.

With reference to FIGS. 1A-C and FIG. 2, the modified hinges 2 or specially designed hinges allow the first vertical member 5 or beam to rotate over 180 degrees; that is directly away from the operator, across the passage way, or move toward the operator standing in front of the gate. Between the two screws 4*a* holding the hinge 2 to the vertical post 5; the hinge 2 has a pre drilled hole 24 for a pivot pin or screw 4*a*. The hole is slightly larger than the pivot screw 4*a*. Placing the drill bit in the hole, a hole is drilled through the vertical beam, equal in size to the hole in the hinge 2.

With reference to FIG. 7A as well, a screw 26, made for anchoring into wood, will pass through this prepared hole, entering the back side of the vertical beam 5, then through a plastic washer 27 and finally, tie into the top horizontal beam 3*a*. A second horizontal beam 3*b* will be used at the bottom of the gate. It will be inverted from the position of the top horizontal beam 3*a*, and tie to the lower end of the vertical beam 5 with a pivot pin 26 as used on the top beam 3*a*.

A lighter weight, or smaller dimension picket of proper length will be attached with a single pivot pin 23, or screw at each end. Additional vertical members 5, referred to as pickets, will space equally across the opening. All pivot points 4*b* will be spaced with plastic or nylon washers 27 to ensure smooth operation when lifting or lowering the gate.

All screws 4*a*, 4*b*, 26 will enter from the back side of the gate, and be of correct length not to break through the front surface of the classic step store gate.

Figure 2:
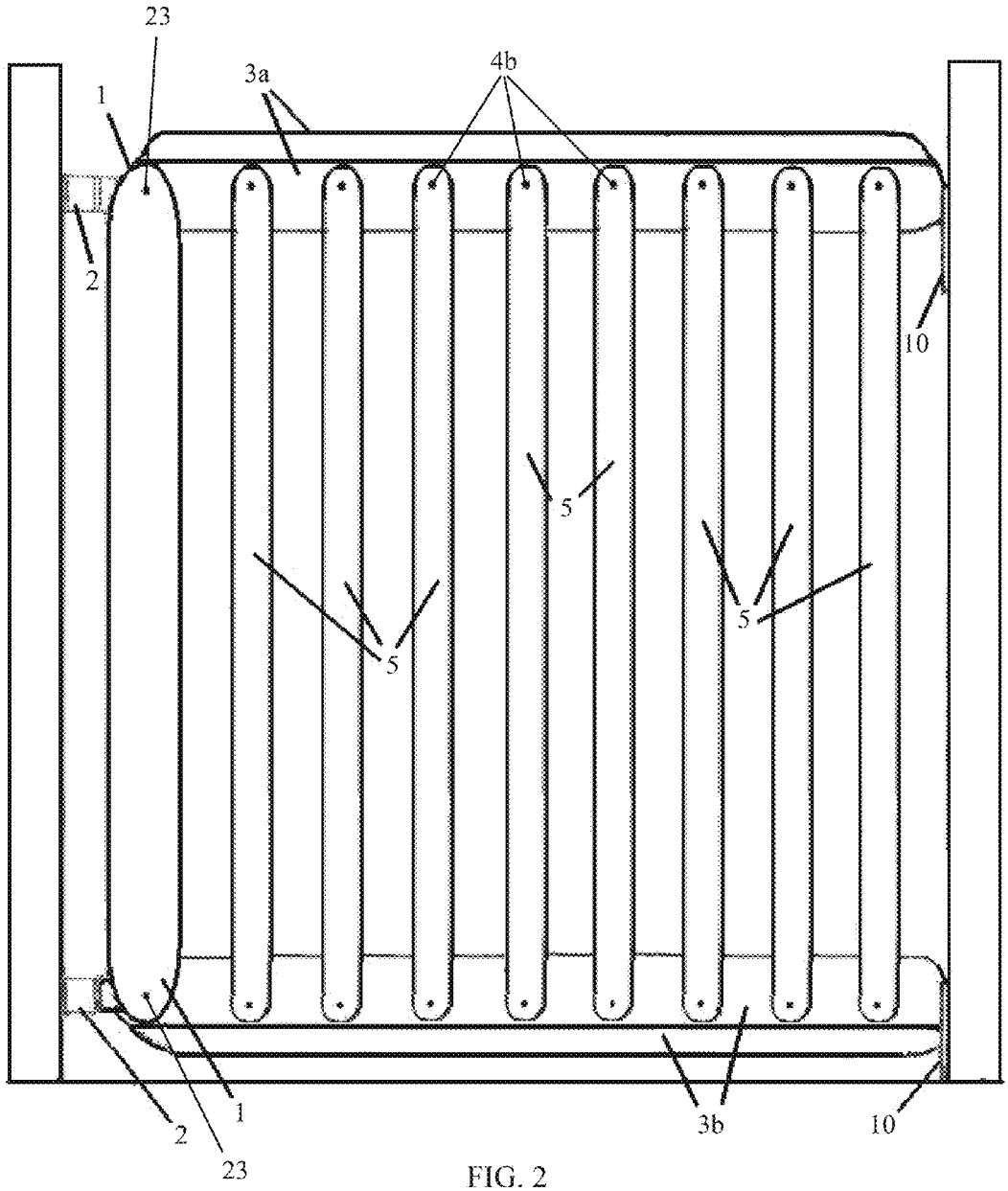
FIG. 2 is a rear elevation view of the gate, according to an embodiment of the present invention.

With reference to FIG. 2, the Rear Elevation view exhibits the gate's structure. The top and bottom of all vertical members 5 are rounded to maintain equal clearance as the gate is raised or lowered to avoid injury to fingers. All vertical members 5 have an equal distance between pivot points 4*b*, and all must be in a direct line and equally spaced, top and bottom. A proper and correct radius must be established, equal to the measure from pivot point 4*b* to the clearance of distance between top and bottom beam 3*a*, 3*b* flanges and the pivot point 4*b* established. This top and bottom clearance distance must stay equal when raising or lowering the gate.

Figure 3:
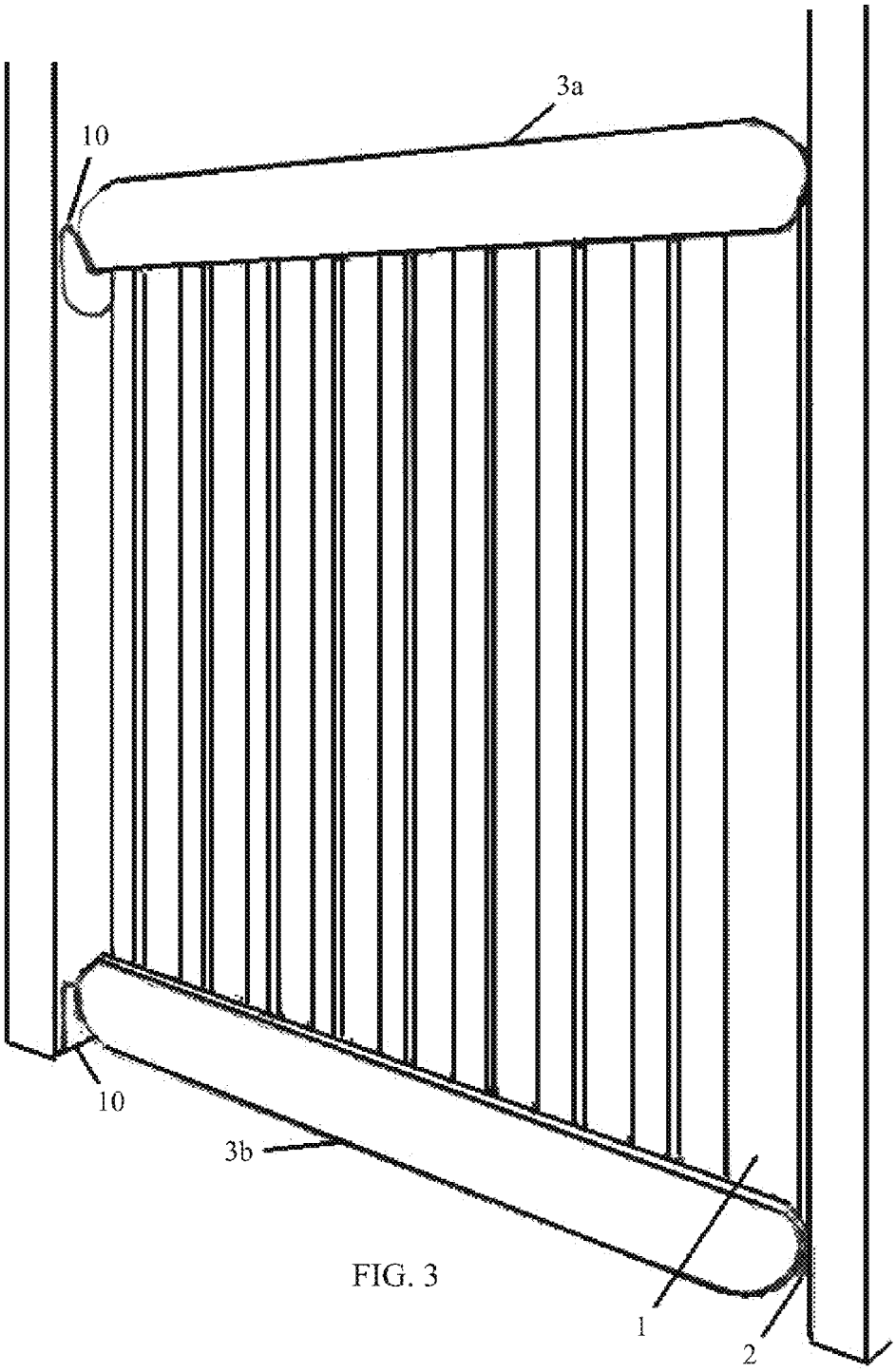
FIG. 3 is a perspective view of the gate, according to an embodiment of the present invention.

With reference to FIG. 3, a Front Elevation perspective view exhibits structure with operating end of gate resting in saddle brackets 10. The gate rests in a saddle bracket 10 when in closed position. These saddles 10 can be of various shapes or sizes and should include a spacer block of equal shape. Spacer blocks (not shown) can be used to adjust clearance, and stop the gate end from scuffing the wall. Spacer blocks can also be used at hinge end of gate if needed.

Figure 4:
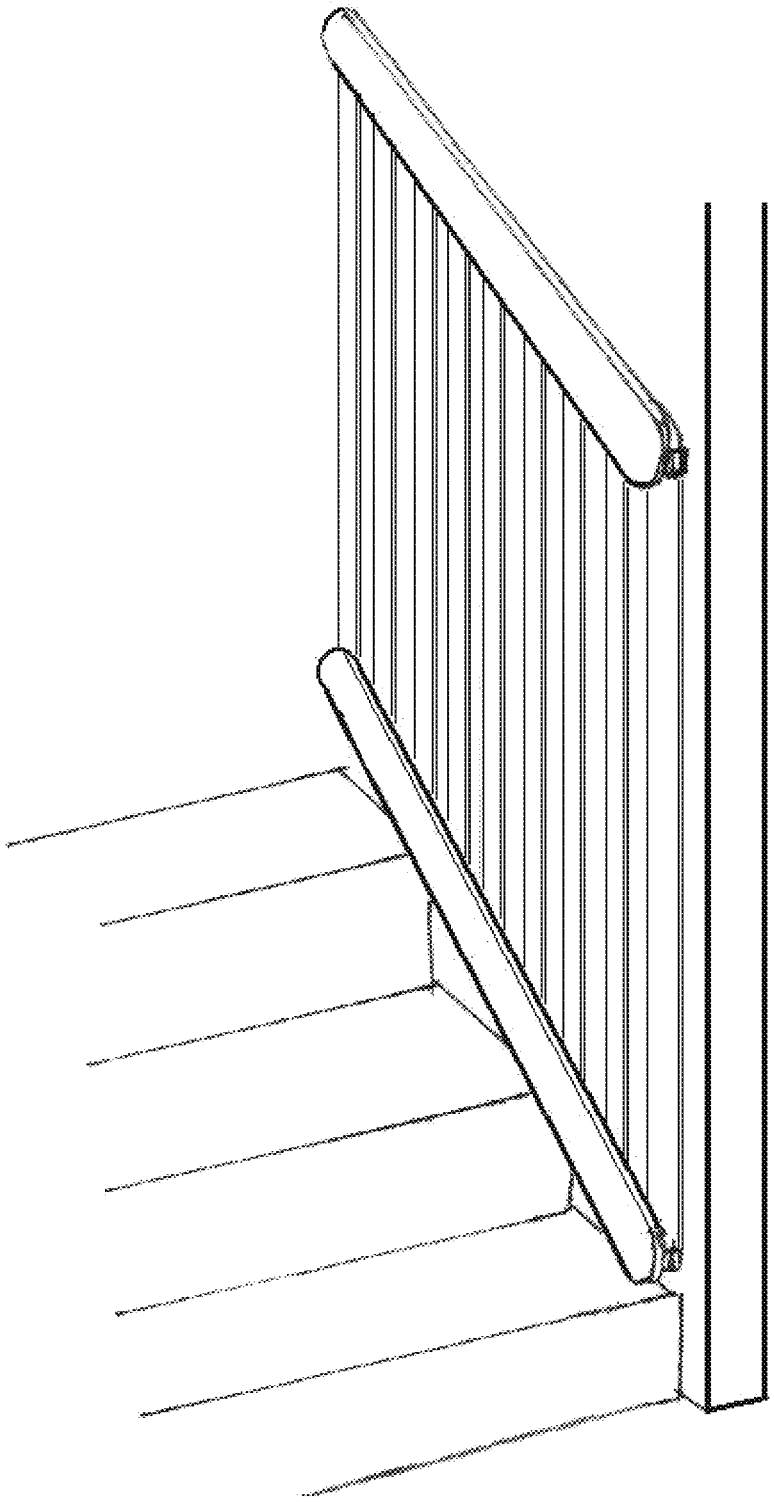
FIG. 4 is a perspective view of the gate in a storage position, according to an embodiment of the present invention.

With reference to FIG. 4, the step storage exhibits a very clean and attractive storage position. A metal hook and slot device could be made. A metal hook and slot device (not shown) could be mounted to hold the hand rail solid. An optional rubber pad (not shown) would hold the bottom beam from scuffing edge of a step. A skilled person could install the device to hold the loose end of the top beam 3*a* to anchor it solidly in place when open. A rubber pad (not shown) would be an option for the contact point with the bottom horizontal beam 3*b* while in storage position. Also note, bottom beam 3*b* and top beams 3*a* are equally made, making it easy to mount the gate to wall or door, right or left hinge.

Figure 5A:
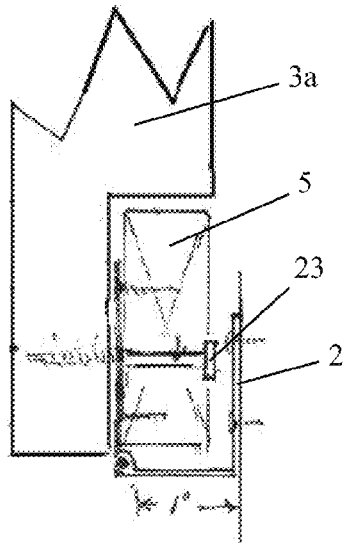
FIG. 5A is a detail top view of the hinge, according to an embodiment of the present invention.
Figure 5B:
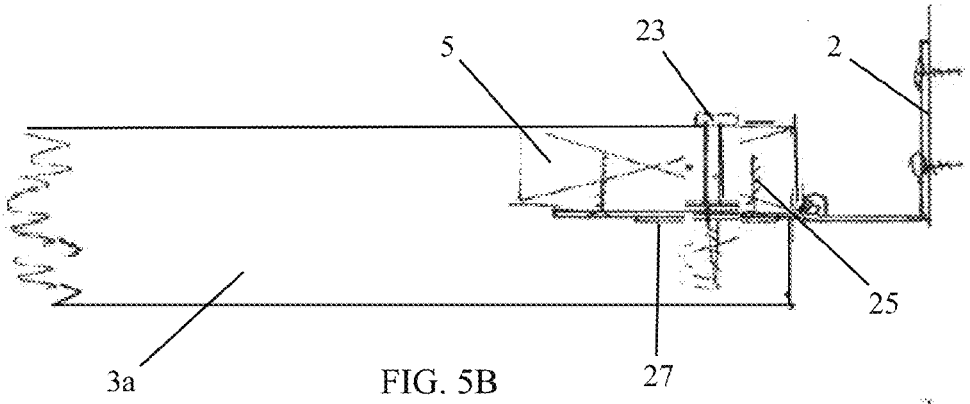
FIG. 5B is a detail top view of the hinge, according to another embodiment of the present invention.
Figure 5C:
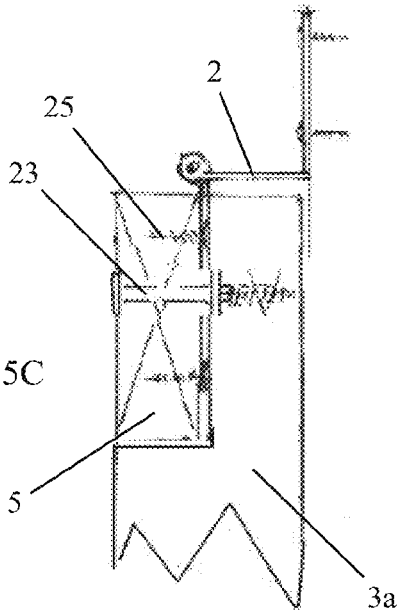
FIG. 5C is a cutaway top view of the hinge, according to an embodiment of the present invention.

FIG. 5 exhibits a detail drawing of top view, looking down. The top rail is drawn with a portion removed to see the three major positions of the gate. Top view illustrates the gate moved away from the operator. It could be lifted for up stairs, or lowered down a set of stairs. When closed, the top rail makes a good safety feature at the top of a stairway or slope. The hinge used in the gate, distributes any stress that might occur, to the steel hinge FIG. 6 exhibits a clean and neat hinge, devised for this use. A specially designed hinge is shown which allows a pivot point pin to pass through the hinge to strengthen the framework, and places the load of the horizontal beams on the steel hinge. This hinge can be a part of this patent. It shows holes drilled in the proper place to reduce stress on wood member of the gate. It would eliminate un-used holes, making the hinge stronger and more attractive. And reduce time when the gate goes into production.

FIG. 7A exhibits a Front Elevation detail, exhibits in dotted lines, the rear of the structure, position of hinge, and how the top beam 3*a* trims out near the ends. It illustrates a nylon washer 27 placed between all members to prevent scuffing. The gate drawing shows a one piece beam 3*a*, rounded top and some operating clearance, needed when the gate is lifted or lowered to the maximum. The hinge 2 fits between the gate members 3*a*, 3*b*, 5, and is illustrated as a hinge 2 made for this purpose.

FIG. 7B showing Section A-A illustrates the gate in the closed position with the top beam cut off. The square end of the hinge 2 is fastened to a door jamb, as in a home for which it was designed at the top of steps declining about 4 feet, to a laundry room and family room.

This gate can also be installed with stick on pads which can be removed without damage. The pads are a standard item for use in closets or on walls for hanging things.

I claim:

1. A gate comprising:

a. a first horizontal beam;

b. a second horizontal beam, wherein both the first horizontal beam and the second horizontal beam have a hinge end and an opening end;

c. a plurality of vertical beams extending between the first horizontal beam and the second horizontal beam, wherein the plurality of vertical beams are connected to the first horizontal beam and the second horizontal beam by a plurality of pivot pins, wherein the plurality of vertical beams are configured to pivot in relation to the first horizontal beam and the second horizontal beam;

d. a first hinge consisting of a first hinge first plate, a first hinge second plate, and a first hinge pin, wherein the first hinge is connected to the hinge end of the first horizontal beam; and e. a second hinge consisting of a second hinge first plate, a second hinge second plate, and a second hinge pin, wherein the second hinge is connected to the hinge end of the second horizontal beam, wherein the first hinge and the second hinge are configured to pivot horizontally, wherein a first end of the first hinge is connected to the first horizontal beam by a first one of the plurality of pivot pins, and a first end of the second hinge is connected to the second horizontal beam by a second one of the plurality of pivot pins, wherein the first horizontal beam and the second horizontal beam are configured to pivot vertically in relation to the first hinge and second hinge respectively, and wherein a second end of each of the first hinge and the second hinge is configured to be fastened to a first side of a doorframe.

2. The gate of claim 1, wherein each of the plurality of pivot pins further comprises a plastic washer.

3. The gate of claim 1, wherein the plurality of pivot pins are screws.

4. The gate of claim 1, wherein the first end of the first hinge is fastened between the hinge end of the first horizontal beam and a first one of the plurality of vertical beams mounted at the hinge end of the first horizontal beam, and wherein the first end of the second hinge is fastened between the hinge end of the second horizontal beam and the first one of the plurality of vertical beams mounted at the hinge end of the second horizontal beam.

5. The gate of claim 1, wherein the plurality of vertical beams are equally spaced along a longitudinal length of the first horizontal beam and the second horizontal beam.

6. The gate of claim 1, wherein the first hinge and the second hinge are strap hinges.

7. The gate of claim 1, wherein the first horizontal beam and the second horizontal beam each have a lengthwise cutaway, wherein a depth of each of the lengthwise cutaways corresponds to a width the plurality of vertical beams, wherein the plurality of vertical beams abut a backside of the first horizontal beam and the second horizontal beam.

8. The gate of claim 1, further comprising a first saddle bracket and a second saddle bracket, wherein the first saddle bracket is configured to receive the opening end of the first horizontal beam, and the second saddle bracket is configured to receive the opening end of the second horizontal beam.

* * * * *